US007997326B2

(12) United States Patent
Onda

(10) Patent No.: US 7,997,326 B2
(45) Date of Patent: Aug. 16, 2011

(54) METAL MOLDING MACHINE AND MOLD CASTING METHOD

(75) Inventor: Hideaki Onda, Tsurugashima (JP)

(73) Assignee: Honda Motor Co., Ltd., Tokyo (JP)

( * ) Notice: Subject to any disclaimer, the term of this patent is extended or adjusted under 35 U.S.C. 154(b) by 445 days.

(21) Appl. No.: 12/329,830

(22) Filed: Dec. 8, 2008

(65) Prior Publication Data

US 2009/0145571 A1 Jun. 11, 2009

(30) Foreign Application Priority Data

Dec. 11, 2007 (JP) ..... 2007-319734

(51) Int. Cl.
*B22D 33/04* (2006.01)
*B29C 33/20* (2006.01)

(52) U.S. Cl. ..... 164/339; 164/341; 164/342; 164/343; 164/137

(58) Field of Classification Search ..... 164/137, 164/341–343, 339, 306–318; 425/186, 451.2, 425/451.5, 451.9, 589, 590, 592, 595
See application file for complete search history.

(56) References Cited

U.S. PATENT DOCUMENTS

| | | | | |
|---|---|---|---|---|
| 6,599,117 | B2 * | 7/2003 | Kasal et al. | 425/593 |
| 6,955,210 | B2 * | 10/2005 | Matsuura et al. | 164/339 |
| 7,186,106 | B2 * | 3/2007 | Kato et al. | 425/169 |
| 2004/0185143 | A1 * | 9/2004 | Nishimura et al. | 425/589 |

FOREIGN PATENT DOCUMENTS

| | | |
|---|---|---|
| JP | 02-241715 | 9/1990 |
| JP | 05-038890 | 10/1993 |
| JP | 07-285154 | 10/1995 |
| JP | 2004-255386 | 9/2004 |

* cited by examiner

*Primary Examiner* — Jessica L Ward
*Assistant Examiner* — Kevin E Yoon
(74) *Attorney, Agent, or Firm* — Rankin, Hill & Clark LLP

(57) ABSTRACT

A metal molding machine includes a fixed mold and a movable mold, a fixed platen holding the fixed mold, an end frame coupled to the fixed platen by tie rods such that the end frame is fixedly mounted on a bed, a movable platen guided by the tie rods, the movable mold being held by the movable platen, and a rolling support mechanism supporting the movable platen. The rolling support mechanism includes a swingable arm, a wheel disposed on a portion of the swingable arm that is closer to the fixed platen and held in rolling contact with the bed, and a spring disposed on a portion of the swingable arm that is closer to the end frame. The spring is interposed between the swingable arm and a portion of the movable platen, for applying a resilient force in a direction so as to lower the wheel.

6 Claims, 7 Drawing Sheets

METAL MOLDING MACHINE AND MOLD CASTING METHOD

BACKGROUND OF THE INVENTION

1. Field of the Invention

The present invention relates to a metal molding machine, and more particularly to a metal molding machine having a movable platen, which is movable between a fixed platen and an end frame while being guided by tie rods. The present invention further relates to a mold casting method, which is carried out using such a metal molding machine.

2. Description of the Related Art

Metal molding machines or injection molding machines have a fixed mold and a movable mold, which are held against each other, thereby jointly defining a mold cavity. A molten material is poured into the mold cavity in order to produce a casting. The movable mold needs to move relatively with respect to the fixed mold. According to Japanese Patent No. 2792431 and Japanese Utility Model Publication No. 05-038890, it has been proposed to guide a movable platen that supports a movable mold with a plurality of tie rods. The fixed mold is secured to a fixed platen, and the tie rods are disposed between the fixed platen and an end frame.

The movable mold is considerably heavy, which tends to cause the tie rods to flex unduly. If the tie rods are sufficiently thick and rigid, the tie rods are prevented from flexing under the weight of the movable mold. However, in this case, the molding machine is liable to be large in size and costly to manufacture.

According to Japanese Patent No. 2792431, the movable platen is supported by a linear guide mounted on a base. According to Japanese Utility Model Publication No. 05-038890, the movable platen is supported on a base by wheels.

Since the movable platen is supported by the linear guide or by wheels according to the above publications, the tie rods are prevented from flexing under the weight of the movable mold.

However, if the relative height of the linear guide disclosed in Japanese Patent No. 2792431 with respect to the movable platen that is held in contact with the linear guide is too small, then the tie rods are not prevented from flexing. Also, if the relative height of the linear guide with respect to the movable platen is too large, then the tie rods tend to flex in the opposite direction. Therefore, the linear guide is required to be highly accurate in terms of the height of the linear guide. Furthermore, the linear guide inevitably causes a certain amount of friction, which makes it difficult for the movable platen to move smoothly.

The wheels disclosed in Japanese Utility Model Publication No. 05-038890 also are required to be considerably accurate in terms of the height thereof. The wheels are mounted on the lower surface of the movable platen, and can appropriately bear the weight of the movable platen. However, since the heavy weight of the movable mold is not directly supported, a rotational moment is produced about a center of gravity of the movable mold, which tends to cause the tie rods to flex excessively.

The surfaces of the wheels are inevitably susceptible to wear in use. Since the surfaces of the wheels are gradually worn down, the wheels cannot maintain the desired height for prolonged periods of time, thus allowing the tie rods to flex excessively.

SUMMARY OF THE INVENTION

It is an object of the present invention to provide a metal molding machine and a mold casting method, which enables a movable platen and a movable mold to be supported appropriately, thereby preventing the tie rods from flexing, and allowing the movable platen to move smoothly.

A metal molding machine according to the present invention comprises a fixed mold and a movable mold, which can be held against each other to jointly define a mold cavity, a fixed platen fixedly mounted on a bed, the fixed mold being held by the fixed platen, and an end frame coupled to the fixed platen by at least one tie rod, the end frame being fixedly mounted on the bed. The metal molding machine further comprises a movable platen that is movable between the fixed platen and the end frame while being guided by the tie rod, the movable mold being held by the movable platen, and a rolling support mechanism supporting the movable platen on the bed. The rolling support mechanism further comprises a swingable arm swingable about a support shaft mounted on the movable platen, a wheel disposed on a portion of the swingable arm that is closer to the fixed platen, and held in rolling contact with the bed, and a resilient member disposed on a portion of the swingable arm that is closer to the end frame. The resilient member being interposed between the swingable arm and a portion of the movable platen, for applying a resilient force in a direction so as to lower the wheel against the bed.

Since the swingable arm of the rolling support mechanism is resiliently supported by the resilient member, the swingable arm is cable of appropriately bearing the movable platen and the movable mold to prevent the tie rod from flexing unduly.

The wheel may be disposed directly below a combined center of gravity of the movable mold and the movable platen, as viewed in side elevation. Disposed in this manner, the wheel is capable of supporting the movable mold and the movable platen in their entirety, thereby preventing undue moments from being produced, and also preventing the tie rod from flexing excessively.

The wheel may be disposed below the movable mold, as viewed in side elevation. Disposed in this manner, the wheel is capable of supporting the movable mold and the movable platen in their entirety, thereby preventing undue moments from being produced, and also preventing the tie rod from flexing excessively. In particular, even if the movable mold is replaced with another movable mold, the wheel still is capable of preventing the tie rod from flexing excessively.

If the distance from the support shaft to the resilient member is greater than the distance from the support shaft to the wheel, then the forces applied to the resilient member are reduced, thereby enabling both the spring constant and the size of the resilient body to be reduced.

A method of casting a molten material using the metal molding machine according to the present invention comprises the steps of moving the movable platen to move the movable mold into abutment against the fixed mold, thereby forming the mold cavity, pouring a molten iron material into the mold cavity, and moving the movable platen in an opposite direction to separate the movable mold from the fixed mold when a surface layer of the poured molten iron material, which is held against the movable mold and the fixed mold, has cooled and solidified into a shell.

Since the movable mold and the fixed mold are separated from each other only when the surface layer of the poured molten iron material has cooled and solidified into the shell, the fixed mold and the movable mold are prevented from mutually seizing.

With the metal molding machine according to the present invention, since the swingable arm of the rolling support mechanism is resiliently supported by the resilient member, the swingable arm is capable of appropriately bearing the movable platen, while the movable mold prevents the tie rod from flexing excessively. When separated from each other, the fixed mold and the movable mold are kept accurately at the same height. Therefore, an iron casting having highly accurate dimensions can be produced. The wheel allows the movable platen to be moved smoothly over the bed. If the swingable arm is set to an appropriate length, so as to position the wheel in a suitable location, then the wheel also can bear the weight of the movable mold, which tends to be heavy, thereby preventing undue moments from being produced, while also preventing the tie rod from flexing excessively.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A metal molding machine and a mold casting method according to an embodiment of the present invention will be described below with reference to FIGS. 1 through 7.

Figure 1:
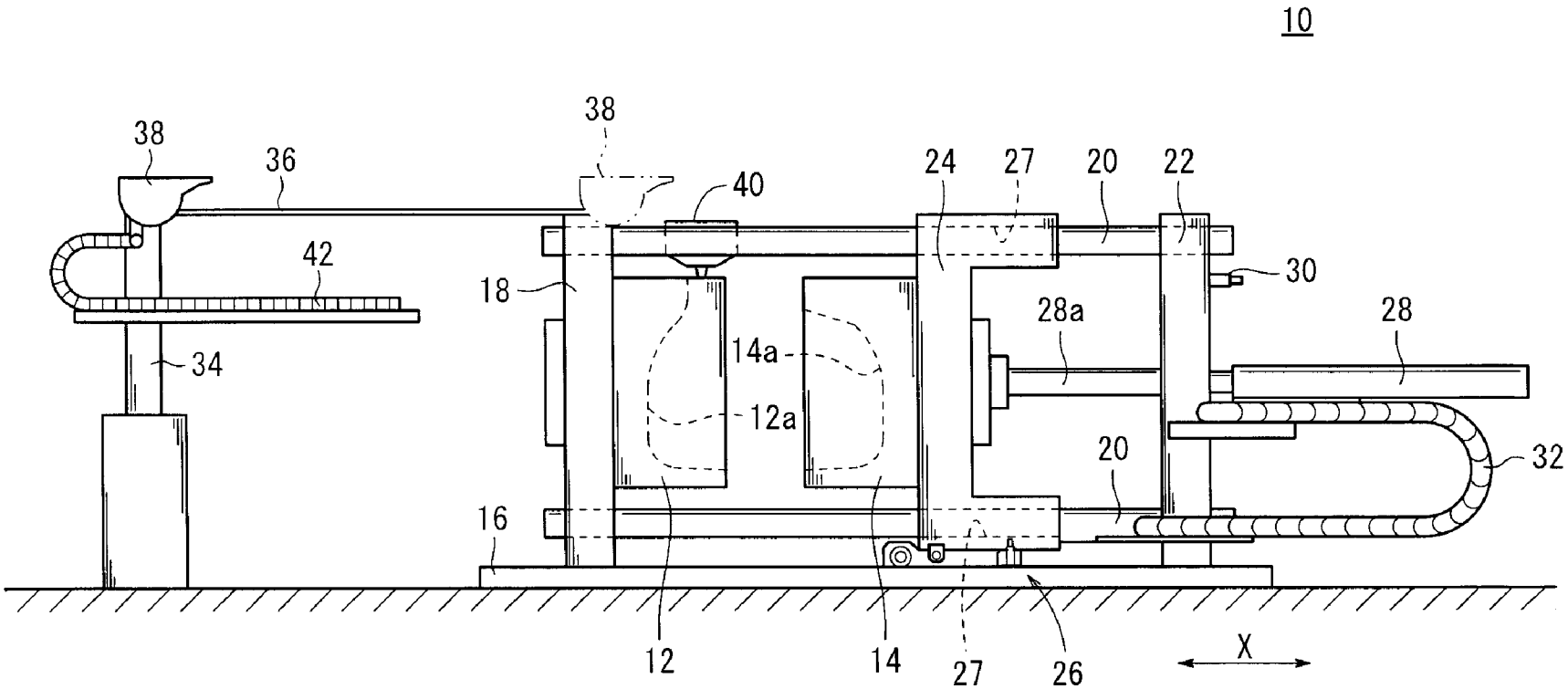
FIG. 1 is a side elevational view of a metal molding machine according to an embodiment of the present invention.
Figure 2:
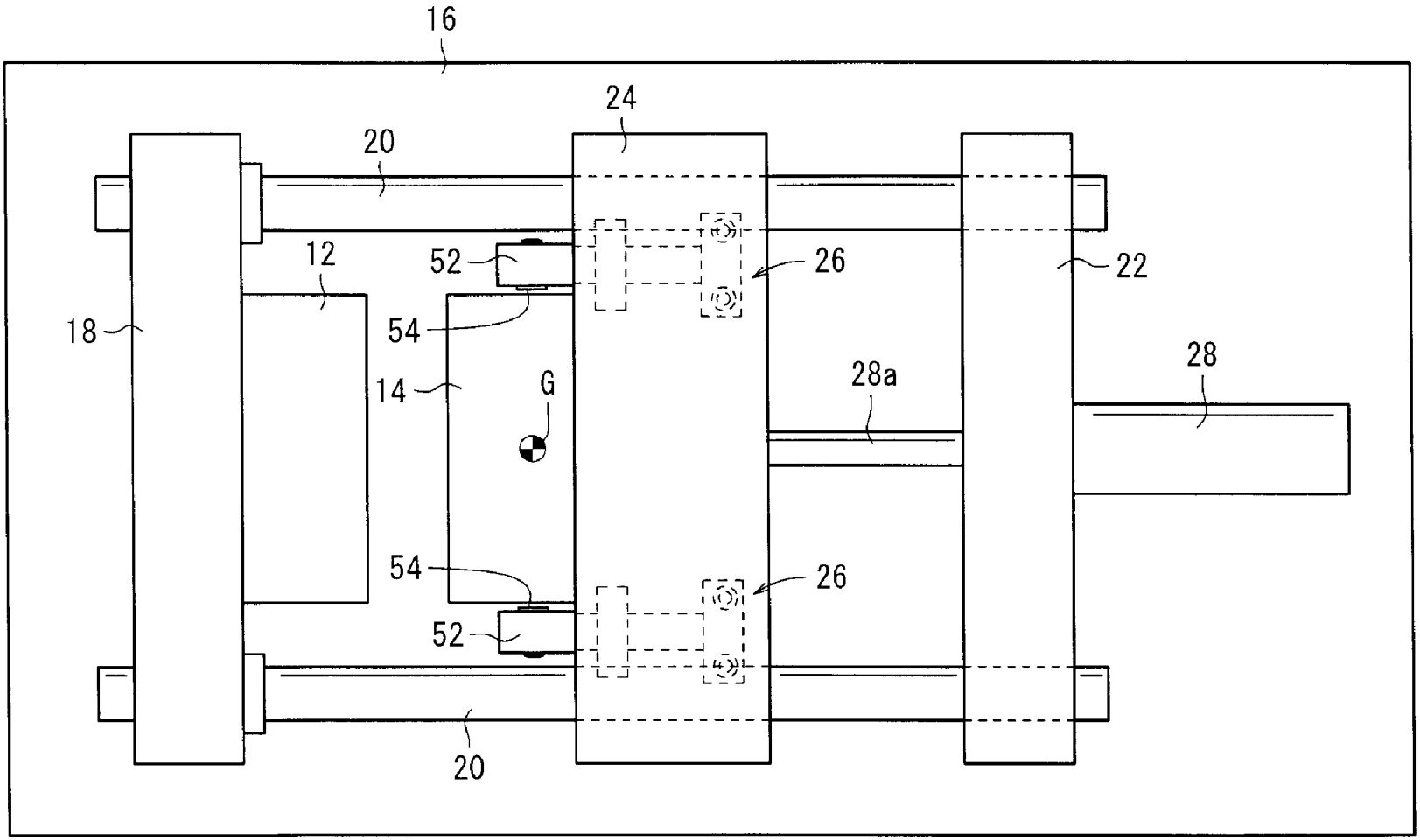
FIG. 2 is a plan view of the metal molding machine according to the embodiment of the present invention.

As shown in FIGS. 1 and 2, a metal molding machine 10 according to the embodiment of the present invention comprises a fixed mold 12 and a movable mold 14, which are held against each other thereby defining a mold cavity, a fixed platen 18 fixedly mounted on a bed 16 and holding the fixed mold 12, and an end frame 22 fixedly mounted on the bed 16 and coupled to the fixed platen 18 by four horizontal tie rods 20. The metal molding machine 10 further comprises a movable platen 24 movable between the fixed platen 18 and the end frame 22 while being guided by the tie rods 20 and holding the movable mold 14, and a pair of rolling support mechanisms 26 that support the movable platen 24 on the bed 16. The four tie rods 20 fit snugly inside and extend through respective guide holes 27, which are defined in the respective four corners of the fixed platen 18. respective recesses 12*a*, 12*a* defined in confronting surfaces thereof. The recesses 12*a*, 12*a* jointly make up a mold cavity when the fixed mold 12 and the movable mold 14 are held together.

A cylinder 28 is mounted on the end frame 22 and includes a rod 28*a* coupled to the movable platen 24. When the rod 28*a* is moved telescopically by the cylinder 28, the rod 28*a* moves the movable platen 24 toward and away from the fixed platen 18. The distance that the movable platen 24 is moved by the rod 28*a* is measured by a sensor 30 disposed on the end frame 22. The measured distance is supplied to a controller, not shown, which performs a positional feedback control process for controlling the position of the movable platen 24. Fluid pipes and electrical wires connected to the movable platen 24 are movably protected by a flexible tube 32.

A support post 34 and a rail 36 are disposed on the left side of the fixed platen 18, as shown in FIG. 1. The rail 36 extends between and interconnects the support post 34 and the fixed platen 18. A pot 38 is movably mounted on the rail 36. When the pot 38 is positioned at the support post 34, the pot 38 is supplied with molten metal from a molten metal supply means, not shown. The pot 38 supplied with molten metal is moved along the rail 36 to the fixed platen 18. When the pot 38 arrives at the fixed platen 18, the pot 38 is tilted in order to pour the molten metal through a funnel 40 into the mold cavity. Fluid pipes and electrical wires connected to the pot 38 are movably protected by a flexible tube 42.

The rolling support mechanisms 26 will be described below. Since the two rolling support mechanisms 26 are identical in structure, only one of the rolling support mechanisms 26 will be described in detail below.

Figure 3:
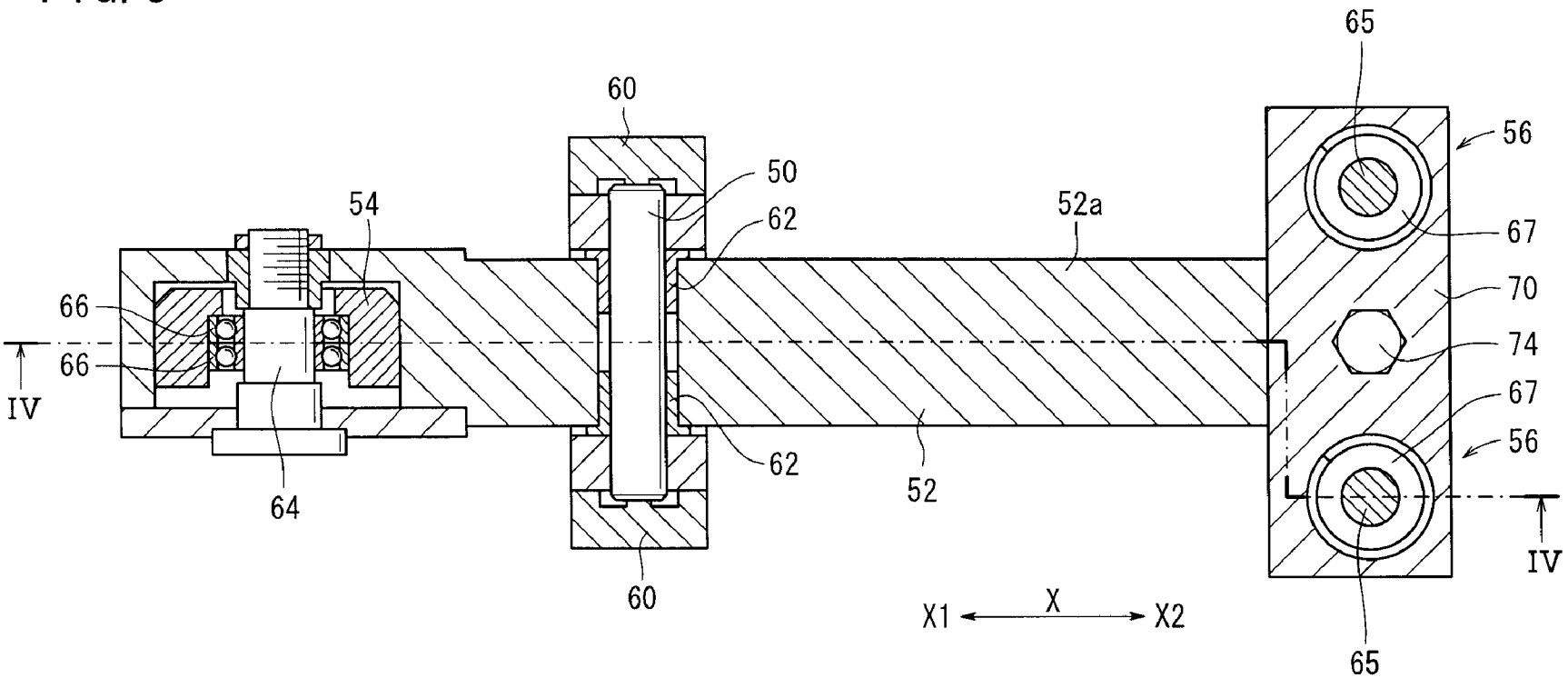
FIG. 3 is a horizontal cross-sectional view of a rolling support mechanism.
Figure 4:
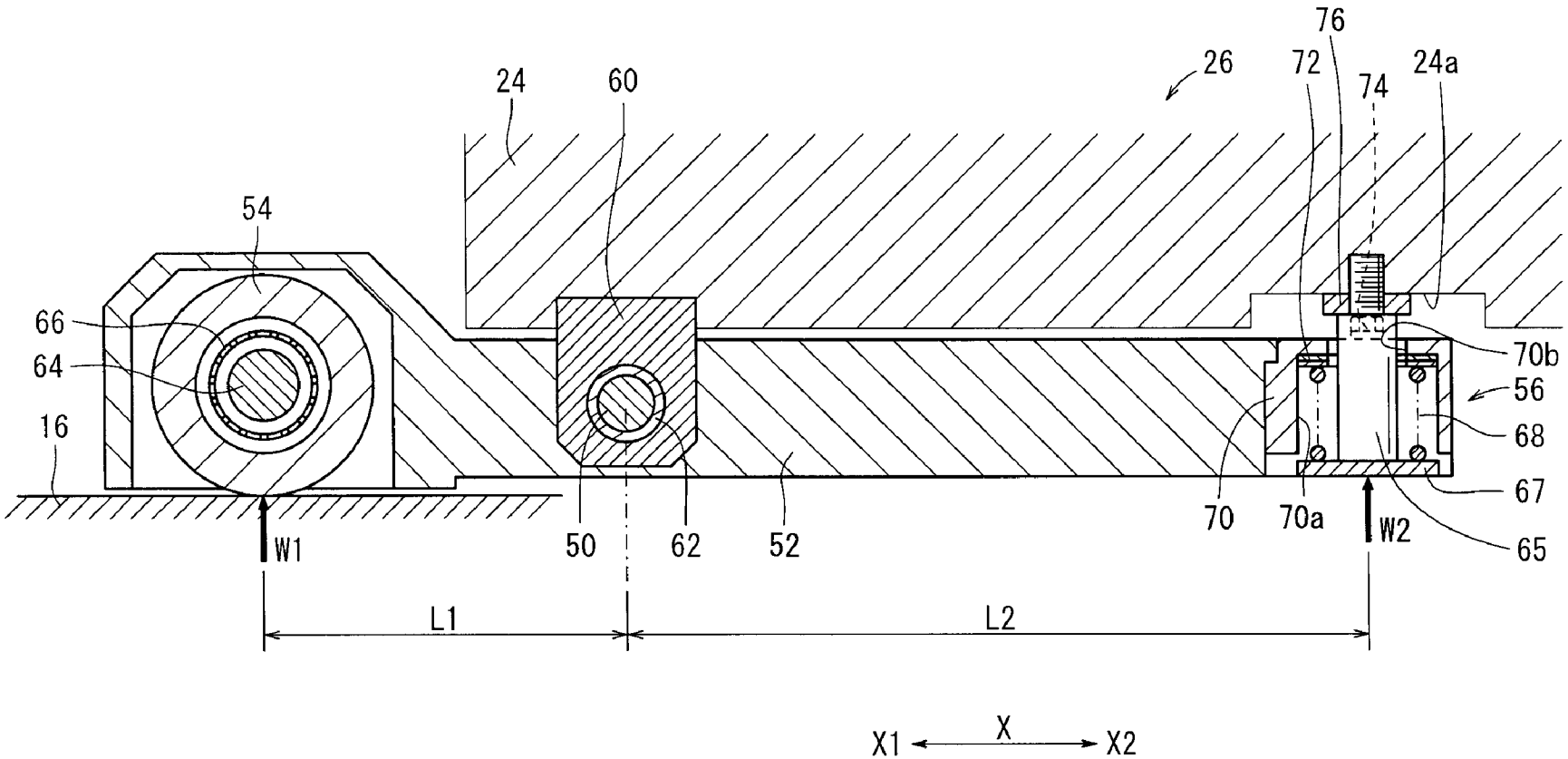
FIG. 4 is a vertical cross-sectional view of the rolling support mechanism taken along line IV-IV of FIG. 3.

As shown in FIGS. 3 and 4, the rolling support mechanism 26 comprises a swingable arm 52, which is mounted on the movable platen 24 by a support shaft 50 for swinging movement thereabout, a wheel 54 mounted on an end of the swingable arm 52 at a position closer to the fixed platen 18 in the direction indicated by the arrow X1 in FIG. 4, and which is held in rolling contact with the bed 16, and a pair of spring bearing mechanisms 56 mounted on an end of the swingable arm 52 at a position closer to the end frame 22 in the direction indicated by the arrow X2 in FIG. 4.

The support shaft 50 is rotatably supported by a pair of support plates 60, which are mounted on the lower surface of the movable platen 24, and a slide bearing 62 interposed between the support shaft 50 and the swingable arm 52.

The wheel 54, which is rotatably mounted on the end of the swingable arm 52 in the direction indicated by the arrow X1, is rotatably supported on a bolt 64 mounted on the swingable arm 52 by a pair of roller bearings 66. The wheel 54 has a lower portion that projects slightly downward from the lower surface of the swingable arm 52, and which is held in rolling contact with the bed 16.

Figure 5:
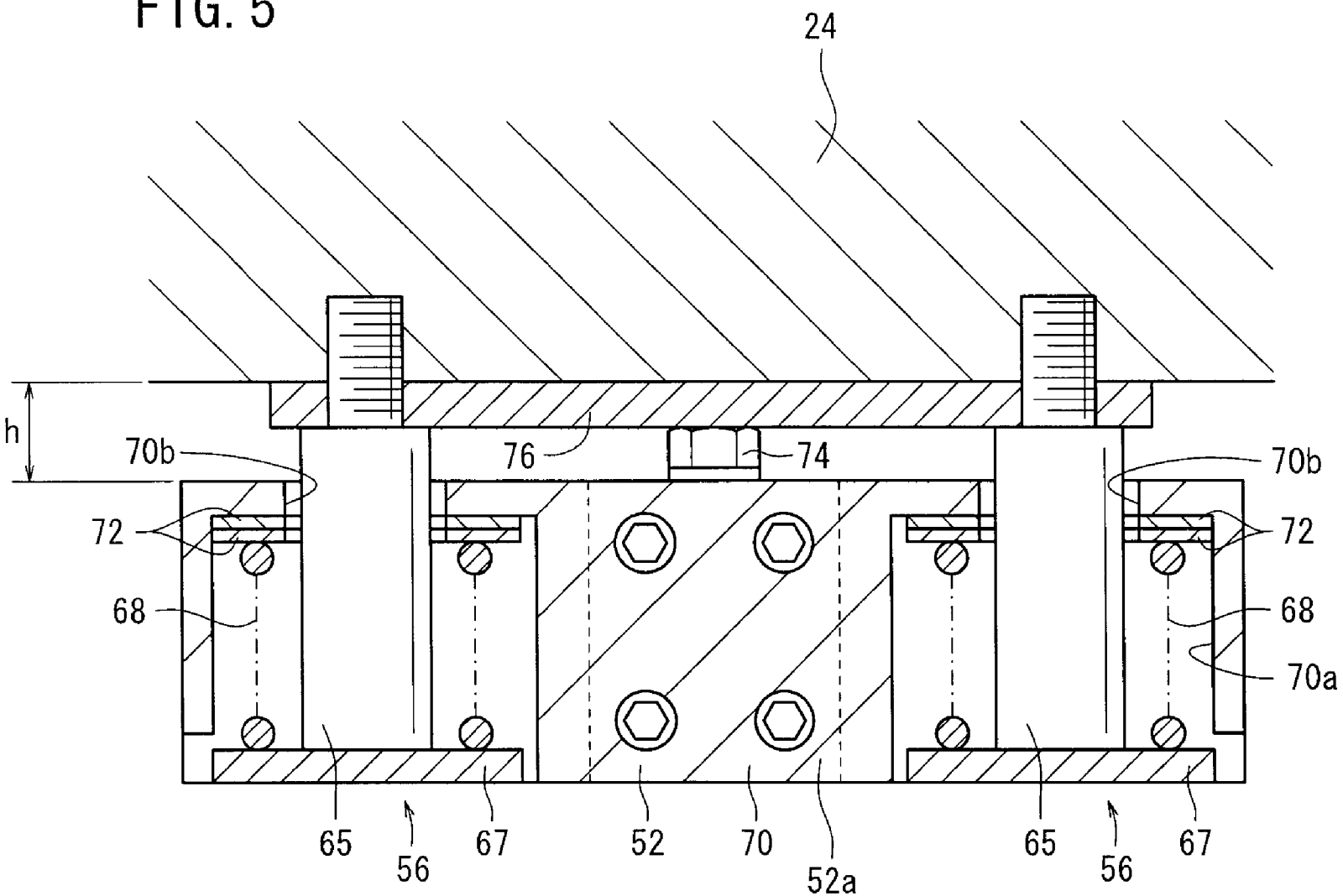
FIG. 5 is an enlarged transverse cross-sectional view, as viewed from behind, of the rolling support mechanism.

Each of the spring bearing mechanisms 56 comprises a pin 65 that projects downwardly from the lower surface of the movable platen 24, a flange 67 fixed to the lower surface of the pin 65, and a spring (resilient member) 68 that acts on the flange 67. The movable platen 24 includes a recess 24*a* defined in an area on the lower surface thereof, which extends around the pin 65. An end member 70, having a downwardly open cavity 70*a*, is mounted on the end of the swingable arm 52 in the direction indicated by the arrow X2. The pin 65 extends through a hole 70*b* defined in an upper wall of the end member 70 above the cavity 70*a*. The flange 67 has a lower surface, which lies substantially flush with the lower surface of the swingable arm 52 when the swingable arm 52 is in a substantially horizontal orientation. A plurality of thin shims 72 are held against the lower surface of the upper wall of the end member 70. The spring 68 is interposed between the shims 72 and the flange 67. A stop 74 is mounted on the upper surface of the upper wall of the end member 70. An upper surface of the stop 74 faces the lower surface of a replaceable abutment plate 76, which is mounted on the lower surface of the recess 24*a*. The stop 74 is located centrally on the swingable arm 52, in the transverse direction thereof as shown in FIG. 5.

The spring 68 is kept under compression for normally urging the end of the swingable arm 52 upwardly in the direction indicated by the arrow X2. Since the swingable arm 52 is pivotally supported by the support shaft 50, the swingable arm 52 tends to move angularly counterclockwise about the support shaft 50, thereby pressing the wheel 54 downwardly against the bed 16. The shims 72 are removably inserted between the lower surface of the upper wall of the end member 70 and the spring 68. Therefore, the number of shims 72 can be changed in order to adjust the resilient force of the spring 68 acting on the flange 67.

The distance L2 from the support shaft 50 to the spring 68 is greater than the distance L1 from the support shaft 50 to the wheel 54. For example, L2=L1×2. The moments about the support shaft 50 are kept in equilibrium. The product of the distance L2 and the resilient forces produced by the springs 68 of all four spring bearing mechanisms 56 is equal to the product of the distance L1 and the reactive forces received by the wheels 54 from the bed 16. Since the distance L2 is greater than the distance L1, and each of the two rolling support mechanisms 26 has two spring bearing mechanisms 56, the force applied per spring 68 is relatively small, and thus, each of the springs 68 may have a relatively small spring constant and size. For the same reasons, the pins 65, the flanges 67, and other parts associated therewith, may have a relatively small mechanical strength.

The stop 74 is adjustable in order to change the gap h between the upper surface of the end member 70 and the lower surface of the movable platen 24. When the rolling support mechanism 26 is manufactured, the stop 74 is adjusted such that the gap h has a predetermined dimension. As shown in FIG. 4, it is assumed that the combined weight of the movable mold 14 and the movable platen 24 is represented by W1, whereas the load on all four springs 68 is represented by W2. When W1×L1≦W2×L2, the stop 74 is held against the abutment plate 76 on the movable platen 24. When W1×L1>W2×L2, the stop 74 is spaced from the abutment plate 76, for bringing the spring bearing mechanisms 56 into operation. In other words, when the movable platen 24 is moved quickly toward and away from the fixed platen 18, the spring bearing mechanisms 56 are kept out of operation.

The springs 68 may be replaced with other resilient members, such as air dampers, stacks of dish springs, or the like. If air dampers are used, then the internal pressure thereof may be adjusted utilizing a given pressure control means, in order to vary the resilient forces of the air dampers. The movable mold 14 and the fixed mold 12 have different weights, depending on the type of workpiece to be molded by the metal molding machine. Depending on the weights of the movable mold 14 and the fixed mold 12 that are used, the pressures of the air dampers may be varied so as to vary the resilient forces thereof.

As shown in FIGS. 3 and 5, the end member 70 extends perpendicularly to a major portion 52*a* of the swingable arm 52. The swingable arm 52 as a whole is substantially T-shaped, as viewed in plan in FIG. 3. The spring bearing mechanisms 56 are disposed in symmetrical positions proximate to the opposite ends of the arm member 70, so as to prevent the swingable arm 52 from being unduly tilted clockwise or counterclockwise about the axis of the swingable arm 52, which extends along the directions indicated by the arrow X. As shown in FIG. 5, the swingable arm 52 is supported in a well-balanced fashion by means of the spring bearing mechanisms 56, and is prevented from being tilted in both clockwise and counterclockwise directions.

As shown in FIG. 2, the rolling support mechanisms 26 are disposed respectively in symmetrical positions, on both sides of the combined center of gravity G of the movable mold 14 and the movable platen 24. Accordingly, the movable platen 24 is supported in a well-balanced fashion, and is prevented from being tilted to the left or to the right.

Figure 6:
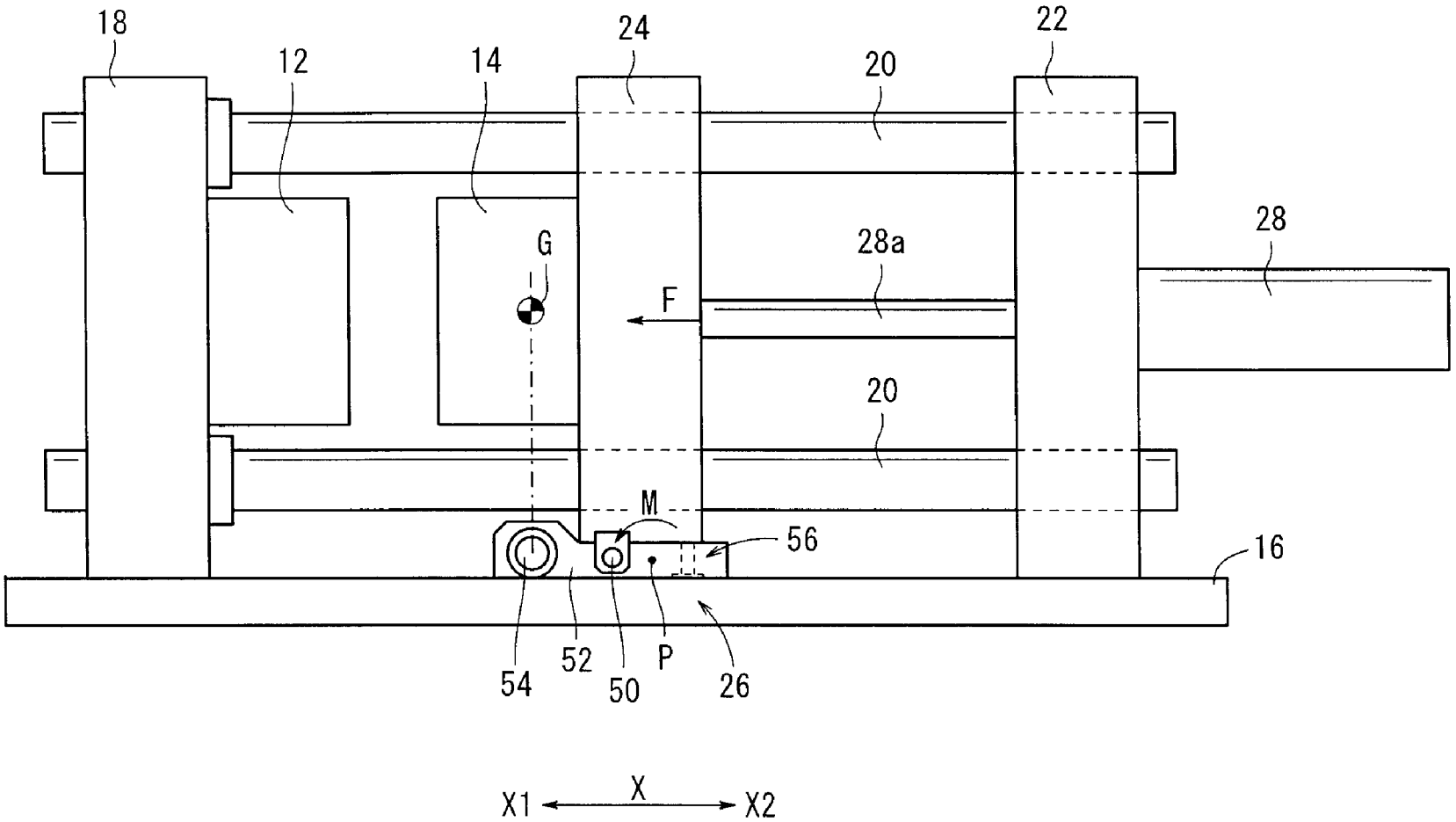
FIG. 6 is a schematic elevational view of the metal molding machine.

As shown in FIG. 6, each of the wheels 54 is disposed directly below a combined center of gravity G of the movable mold 14 and the movable platen 24, as viewed in side elevation. Since the swingable arm 52 extends in the direction indicated by the arrow X1, the wheel 54 can be positioned directly below the combined center of gravity G, rather than below the movable platen 24. The wheels 54 are thus capable of supporting the movable mold 14 and the movable platen 24 in their entirety, thereby preventing undue moments from being produced, and also preventing the tie rods 20 from flexing excessively.

The combined center of gravity G may sometimes be difficult to determine with accuracy. Also, the movable mold 14 may be replaced with another movable mold having a different weight. Accordingly, each of the wheels 54 may simply be located somewhere below the movable mold 14, as viewed in side elevation. When located in this manner, the wheels 54 are capable of supporting the movable mold 14 and the movable platen 24 in their entirety. Further, the wheels 54 prevent undue moments from being produced, and also prevent the tie rods 20 from flexing excessively. In particular, even if the movable mold 14 is replaced with another movable mold, the wheels 54 are still highly effective at preventing the tie rods 20 from flexing excessively.

Most of the combined weight of the movable mold 14 and the movable platen 24 is borne by the rolling support mechanisms 26, while almost no load is applied to the tie rods 20. Thus, the tie rods 20 are prevented from flexing unduly. Accordingly, the tie rods 20 are not required to bear, by themselves, the combined weight of the movable mold 14 and the movable platen 24, and it is sufficient if the tie rods 20 are strong enough to guide the movable platen 24.

As shown in FIG. 4, in order for the wheels 54 to bear all of the weight T1 of the movable mold 14 and the movable platen 24, the load W2 acting on the four springs 68 is expressed as W2=W1×L1/L2. Since the springs 68 produce resilient forces that are proportional to the extent to which the springs 68 are compressed, the spring constants thereof may be set such that the load W2 is applied when the swingable arm 52 is in a horizontal position, for example.

The rolling support mechanisms 26 bear the movable platen 24 through the springs 68. Therefore, because dimensional accuracy errors are absorbed by flexing of the springs 68, the wheels 54 and the swingable arms 52 can have a somewhat lower dimensional accuracy. When the wheels 54 become worn, the change in diameter of the wheels 54 also is absorbed by flexure of the springs 68. The extent to which the springs 68 flex changes only slightly, and thus the function of the springs 68 to bear the movable platen 24 essentially is not affected. Since the wheels 54 roll on the bed 16, the rolling support mechanisms 26 are capable of moving the movable platen 24 smoothly over the bed 16.

As shown in FIG. 6, the rod 28*a* of the cylinder 28 pushes the central area of the rear surface of the movable platen 24 under a force F. In the metal molding machines of the related art, since the movable platen 24 is born at a position near a point P on a lower portion of the movable platen 24, a moment M tends to be produced about the point P that forces the movable platen 24 to turn about the point P. By contrast, with the metal molding machine 10 according to the present embodiment, since the movable platen 24 is borne by the wheels 54, which are positioned forwardly of the point P, and further since the wheels 54 are located directly below the combined center of gravity G, any moment M produced about the point P is sufficiently small.

With the metal molding machine 10 according to the present embodiment, as described above, since the swingable arms 52 of the rolling support mechanisms 26 are resiliently supported by springs 68, the swingable arms 52 are capable of appropriately bearing the movable platen 24 and the movable mold 14 in order to prevent the tie rods 20 from flexing excessively. The wheels 54 of the rolling support mechanisms 26 allow the movable platen 24 to move smoothly over the bed 16. If the swingable arms 52 are set to an appropriate length, so as to position the wheels 54 away from the movable platen 24 in the direction indicated by the arrow X1, then the wheels 54 also can bear the weight of the movable mold 14, which is heavy, so as to prevent undue moments from being produced, and also prevent the tie rods 20 from flexing excessively.

A mold casting method carried out using the metal molding machine 10 thus constructed shall be described below.

First, the movable platen 24 is moved on the bed 16 in the direction indicated by the arrow X1, until the movable platen 24 is held against the fixed mold 12, thereby forming the mold cavity.

Then, a suitable amount of molten iron material, e.g., spheroidal graphite cast iron, is poured from the pot 38 and through the funnel 40 into the mold cavity.

Figure 7:
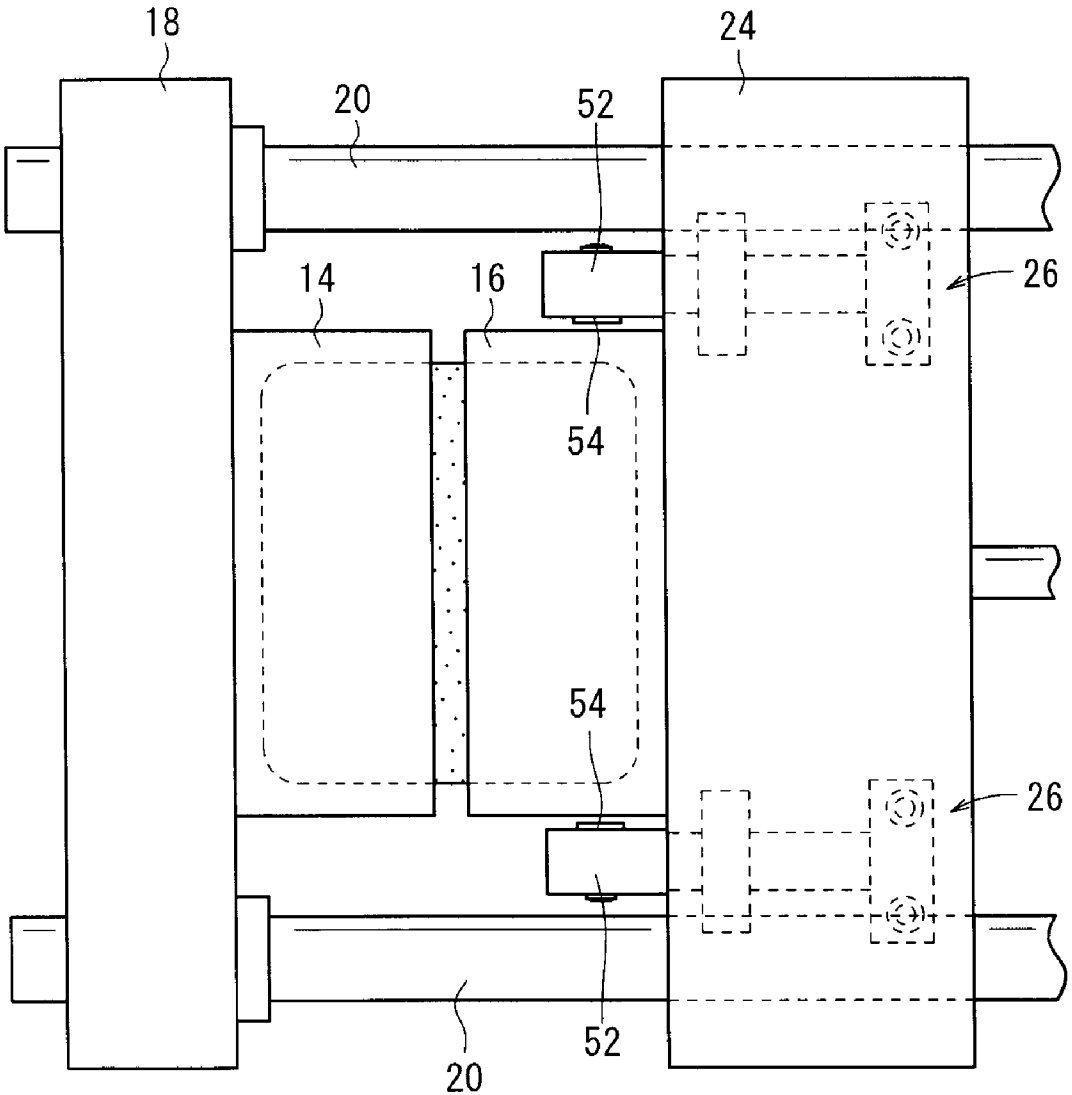
FIG. 7 is a fragmentary plan view showing the manner in which a movable mold is separated from a fixed mold.

When the molten iron material has been cooled naturally or forcibly, until a surface layer thereof that is held in contact with the movable mold 14 and the fixed mold 12 has solidified into a shell, the movable platen 24 is displaced a small distance in the direction indicated by the arrow X2, so as to separate the movable mold 14 from the fixed mold 12, as shown in FIG. 7. At this time, the surface layer of the molten iron material has solidified into a shell as described above, so that the molten iron material does not spill from between the movable mold 14 and the fixed mold 12. Since the movable mold 14 is separated from the fixed mold 12 after the surface layer of the molten iron material has solidified into the shell, the fixed mold 12 and the movable mold 14 are prevented from mutually seizing. Furthermore, since the tie rods 20 are prevented from flexing excessively, the fixed mold 12 and the movable mold 14 when separated from each other are kept accurately at the same height. Therefore, an iron casting, e.g., a camshaft, having highly accurate dimensions can be produced.

In the metal molding machines according to the related art, since the movable platen 24 is borne at a position near the point P, the movable platen 24 tends to undergo a counterclockwise moment M, as shown in FIG. 6, due to the weight of the heavy movable mold 14 at the instant the fixed mold 12 and the movable mold 14 are separated from each other. As a result, the molten iron material, in the form of a camshaft, for example, which is still soft within the solidified shell at the time the fixed mold 12 and the movable mold 14 are separated from each other, is liable to become deformed, e.g., warped back. In contrast, the metal molding machine 10 according to the present embodiment is free of such drawbacks.

The time at which the surface layer of the molten iron material becomes solidified into a shell may be determined experimentally, or may be estimated based on temperature information obtained from a temperature sensor or the like, or such a time may be both determined experimentally and estimated from temperature information.

Thereafter, when the molten iron material has fully solidified, the movable platen 24 is sufficiently displaced in the direction indicated by the arrow X2, and the produced iron casting is removed.

Although a certain preferred embodiment of the present invention has been shown and described in detail, it should be understood that various changes and modifications may be made to the embodiment without departing from the scope of the invention as set forth in the appended claims.

What is claimed is:

1. A metal molding machine comprising:

a fixed mold and a movable mold, which can be held against each other to jointly define a mold cavity;

a fixed platen fixedly mounted on a bed, said fixed mold being held by said fixed platen;

an end frame coupled to said fixed platen by at least one tie rod, said end frame being fixedly mounted on said bed;

a movable platen movable between said fixed platen and said end frame while being guided by said tie rod, said movable mold being held by said movable platen; and a rolling support mechanism supporting said movable platen on said bed, wherein said rolling support mechanism further comprises:

a swingable arm swingable about a support shaft mounted on said movable platen;

a wheel disposed on a portion of said swingable arm that is closer to said fixed platen, and held in rolling contact with said bed; and a resilient member disposed on a portion of said swingable arm that is closer to said end frame, said resilient member being interposed between said swingable arm and a portion of said movable platen, for applying a resilient force in a direction so as to lower said wheel against said bed.

2. The metal molding machine according to claim 1, wherein said wheel is disposed directly below a combined center of gravity of said movable mold and said movable platen, as viewed in side elevation.

3. The metal molding machine according to claim 1, wherein said wheel is disposed below said movable mold, as viewed in side elevation.

4. A method of casting a molten material on a metal molding machine comprising a fixed mold and a movable mold, which can be held against each other to jointly define a mold cavity, a fixed platen fixedly mounted on a bed, said fixed mold being held by said fixed platen, an end frame coupled to said fixed platen by at least one tie rod such that said end frame is fixedly mounted on said bed, a movable platen movable between said fixed platen and said end frame while being guided by said tie rod, said movable mold being held by said movable platen, and a rolling support mechanism supporting said movable platen on said bed, wherein said rolling support mechanism further comprises a swingable arm swingable about a support shaft mounted on said movable platen, a wheel disposed on a portion of said swingable arm that is closer to said fixed platen so that the wheel is held in rolling contact with said bed, and a resilient member disposed on a portion of said swingable arm that is closer to said end frame, said resilient member being interposed between said swingable arm and a portion of said movable platen, for applying a resilient force in a direction so as to lower said wheel against said bed, said method comprising the steps of:

moving said movable platen in one direction to bring said movable mold into abutment against said fixed mold, thereby forming said mold cavity;

pouring a molten iron material into said mold cavity; and moving said movable platen in an opposite direction so as to separate said movable mold from said fixed mold when a surface layer of the poured molten iron material, which is held against said movable mold and said fixed mold, is cooled and solidified into a shell.

5. A method according to claim 4, wherein said wheel is disposed directly below a combined center of gravity of said movable mold and said movable platen, as viewed in side elevation.

6. A method according to claim 4, wherein said wheel is disposed below said movable mold, as viewed in side elevation.

* * * * *